US007320574B2

(12) United States Patent
Greim et al.

(10) Patent No.: US 7,320,574 B2
(45) Date of Patent: Jan. 22, 2008

(54) TURBOMACHINE

(75) Inventors: Ralf Greim, Birmenstorf (CH); Said Havakechian, Baden (CH); Axel Pfau, Ettingen (CH)

(73) Assignee: Alstom Technology Ltd, Baden (CH)

( * ) Notice: Subject to any disclaimer, the term of this patent is extended or adjusted under 35 U.S.C. 154(b) by 338 days.

(21) Appl. No.: 10/936,582

(22) Filed: Sep. 9, 2004

(65) Prior Publication Data

US 2005/0100439 A1 May 12, 2005

(30) Foreign Application Priority Data

Sep. 9, 2003 (EP) ..... 03103323

(51) Int. Cl.
*F01D 11/08* (2006.01)

(52) U.S. Cl. ..... 415/173.5; 415/170.1

(58) Field of Classification Search ..... 415/10, 415/118, 119, 126, 128, 170.1, 171.1, 173.1, 415/173.2, 173.5, 914
See application file for complete search history.

(56) References Cited

U.S. PATENT DOCUMENTS

| | | | | |
|---|---|---|---|---|
| 2,278,041 A | | 3/1942 | Allen | |
| 3,893,782 A | | 7/1975 | Pierpoline et al. | |
| 3,989,406 A | * | 11/1976 | Bliss | 415/1 |
| 4,662,820 A | | 5/1987 | Sasada et al. | |
| 6,102,655 A | * | 8/2000 | Kreitmeier | 415/173.3 |
| 6,375,416 B1 | * | 4/2002 | Farrell et al. | 415/119 |
| 6,464,460 B2 | * | 10/2002 | El-Nashar et al. | 416/92 |
| 7,066,713 B2 | * | 6/2006 | Dube et al. | 415/173.5 |

FOREIGN PATENT DOCUMENTS

| | | |
|---|---|---|
| CH | 598787 | 5/1978 |
| DE | 2462465 | 4/1977 |
| EP | 1067273 A1 | 1/2001 |
| JP | 56069402 | 6/1981 |

* cited by examiner

*Primary Examiner*—Hoang Nguyen
(74) *Attorney, Agent, or Firm*—Buchanan Ingersoll & Rooney PC

(57) ABSTRACT

A turbomachine has, on its inner casing (5) and on its shaft, recesses into which shrouds of rotor blades and/or of guide vanes (2*a*) protrude. The recesses are configured with wave-shaped contouring arrangements (10), which extend over their periphery. The contouring (10) extends over axially extending regions of the recess and consists of periodic elevations and depressions (14, 15) in the radial direction. They can also be effected on the radially extending regions of the recess and on the shrouds. The undulation-shaped contouring arrangements are used to counteract existing pressure fields and to reduce performance losses due to mixing processes between the leakage flow and the main flow.

12 Claims, 4 Drawing Sheets

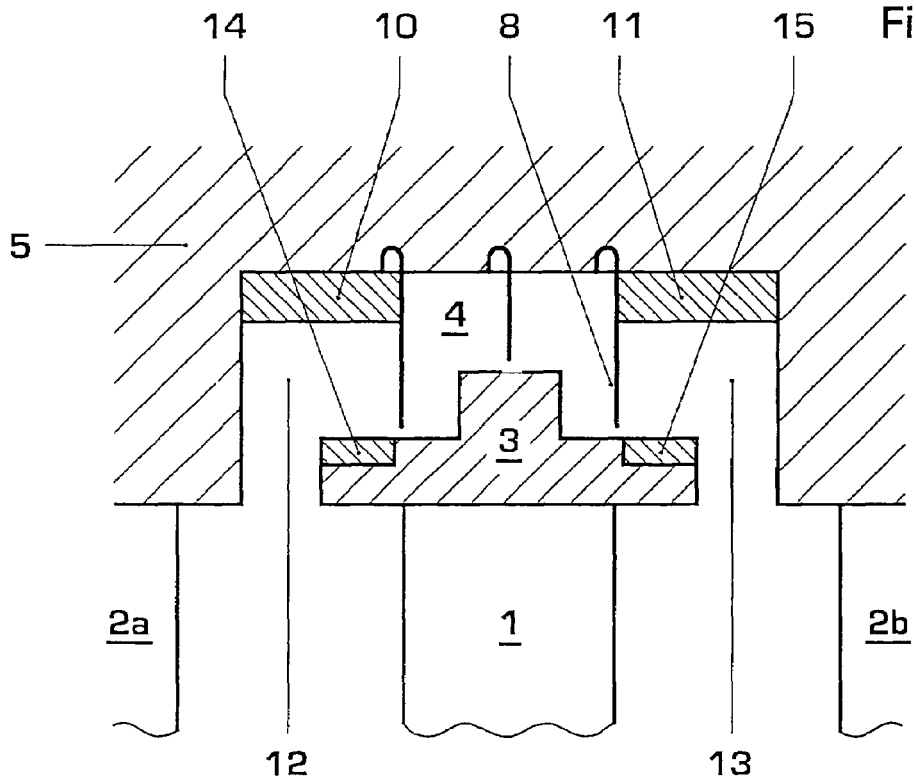
Fig. 2a
Fig. 2b
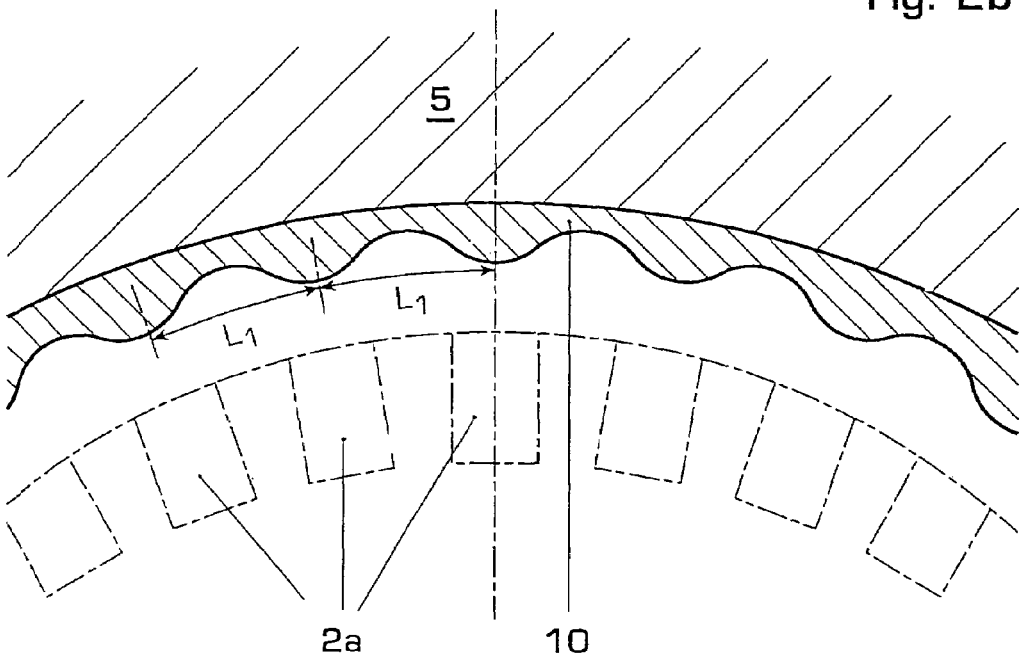

TURBOMACHINE

TECHNICAL FIELD

The invention relates to a turbomachine whose blading has shrouds and, in particular, cavities into which the shrouds protrude.

STATE OF THE ART

For the purpose of damping vibrations in turbomachines, the blading is provided with shrouds which connect, as a ring, all the blading tips of a blading row. They are employed for both rotor blades and guide vanes. In order to keep the leakage flow past the shrouds as small as possible, recesses or cavities are formed in the machine inner casing and in the shaft, with the shrouds of the rotor blades and the guide vanes protruding into these recesses or cavities. The leakage flow is further limited by labyrinth seals in the cavities. Such labyrinth seals are shown, for example, in FIG. 1 of this patent application. This shows an excerpt from a turbomachine, in particular an excerpt from a rotor blade 1 and the adjacent guide vanes 2*a*, 2*b*. The rotor blade 1 is provided with a shroud 3 which protrudes into a recess or cavity 4 of the inner casing 5 of the machine. A corresponding guide vane shroud protrudes into a similar recess in the shaft. A labyrinth seal is arranged within the cavity 4 in order to restrict leakage flows, which are indicated by an arrow 6 and flow through between the shroud 3 of the rotor blade 1 and the internal casing and outside the main or working flow 7. This seal consists, in the main, of a plurality of sealing strips 8, which extend radially inward from the wall of the inner casing toward the shroud. In addition, the shroud 3 is, for example, equipped with steps in the radial direction, with the shroud having a constant shape over its periphery. The leakage flow 6 flows via an inlet region into the cavity 4, through between the sealing strips and the shroud and, via an outlet region, back to the main flow 7 of the turbomachine. Mixing processes between leakage flow and main flow occur in the inlet and outlet regions, which mixing processes disturb inter alia the main flow and working flow and cause losses in performance.

U.S. Pat. No. 4,662,820 from Sasada et al reveals a labyrinth seal with a stepwise design of shroud and a plurality of sealing strips. The cavity, into which the shroud protrudes, is configured by inserts 12, 12*a* or shaping 15, 15*b* of the inner casing wall. Due to this, the cavity has a varying shape in the axial and/or radial direction, its shaping being constant in the peripheral direction. The inserts are used to reduce the space through which a leakage can flow and, by this means, to improve the performance of the machine.

PRESENTATION OF THE INVENTION

The object of the present invention is to create a turbomachine in which the performance losses due to mixing processes between the leakage flow and the main flow are reduced. A turbomachine has rotor blades and guide vanes which are respectively fastened in blading rows to a shaft or an inner casing, at least one rotor blade row and at least one guide vane row being respectively provided with a shroud. The inner casing and the shaft have cavities into which the shrouds protrude. In accordance with the invention, the cavities, the shrouds or both the cavities and the shrouds have contouring or a varying profile in the peripheral direction. The contouring consists of periodically repeating elevations and depressions which are therefore uniformly distributed over the periphery and have the same dimension in each case. In this arrangement, the contouring has an undulation length, i.e. a profile section, which is repeated several times in the peripheral direction. In the case of the contouring of the cavity, this undulation length is equal to a fraction of the peripheral length of the cavity wall, i.e. the peripheral length along either the inner casing wall or the shaft. In the case of the contouring of a shroud, the undulation length is equal to a fraction of the peripheral length of this shroud. More precisely, the undulation length corresponds in each case to the peripheral length of the cavity wall or of the shroud divided by the straightforward number of blades or guide vanes or by a whole number multiple of the number of blades, in the blading row which is adjacent to the cavity or which is associated with the shroud.

Contouring according to the invention causes a pressure field which acts against steady-state and non-steady-state pressure fields which would, otherwise, generate the losses. In this case, pressure fields are involved which occur due to the presence of the blading together with the lack of blading between the blading rows, stagnation points being generated at the blading leading edges and blading trailing edges. These pressure fields not only act in the main flow field but also act in the region of the labyrinth at the blading shroud and, in particular, in the region of the leakage flow inlet into the cavity and the leakage flow outlet from the cavity. Due to the interaction between these pressure fields, an exchange occurs between the main flow and the leakage flow, flows being effected in the peripheral direction in the labyrinth cavities in the direction of the labyrinth and in the direction of the main flow. These flows lead to mixing processes which generate performance losses. The new pressure field effected by the contouring of a cavity wall or a shroud equalizes, in the peripheral direction, the pressure fields of the blading row which is immediately adjacent, upstream or downstream, to the cavity. The pressure field which is generated by the contouring of a shroud equalizes, in the peripheral direction, the pressure fields of that blading row which is associated with the shroud. By this means, the mixing processes between the main flow and leakage flow are reduced and, therefore, the frictional and mixing losses caused by the mixing processes are also diminished. In order to achieve this effect in an optimum manner, the elevations and the depressions in the respective cavity wall and/or the shroud are positioned in such a way that the maxima of those pressure fields which are generated by the adjacent blading rows are weakened and the pressure minima between the blade rows are equalized by increased pressure.

The cavities involved are both cavities on the inner casing, into which the shrouds of the rotor blades protrude, and cavities on the shaft, into which the shrouds of the guide vanes protrude. The pressure relationships are comparable in the two cases.

The contouring undulation lengths are matched to the pressure fields which they equalize. More specifically, their undulation lengths are matched to correspond with the number of blades or guide vanes in a blading row. In the case of cavity wall contouring, the latter has an undulation length equal to the peripheral length of the cavity divided by the number of blades or vanes or by a whole number multiple of the number of blades or vanes in the blading row immediately adjacent, upstream or downstream, to the contouring. In the case of shroud contouring, the latter has an undulation length equal to the peripheral length of the cavity divided by the number of blades or vanes or by a whole number multiple of the number of blades or vanes in the blading row which is associated with the shroud.

In a first preferred embodiment of the invention, the contouring is located on the axially extending walls of a cavity, the elevations and depressions of the contouring extending in the radial direction, i.e. radially inward or radially outward. In the case of a shroud cavity in the region of a rotor blade, the contouring is to be understood as elevations and depressions on the inner casing wall; in the case of a shroud cavity in the region of a guide vane, it is to be understood as elevations and depressions on the shaft. The contouring extends over the inlet region or over the outlet region of the cavity or even over both regions. The inlet region is the region of the recess as far as the first sealing strip in the flow direction and the outlet region is the region of the recess from the last sealing strip in the flow direction. Contouring is preferred in the inlet region and/or the outlet region, contouring being also achievable in other parts of the cavity or over the complete cavity. Contouring in the inlet region of the cavity has an undulation length which is matched to the number of blades or vanes in the blade or vane row located adjacently upstream. Contouring in the outlet region of the cavity has an undulation length which is matched to the number of blades or vanes in the blade or vane row located adjacently downstream.

In a second preferred embodiment of the invention, the contouring is located on the radially extending walls of a cavity, the elevations and depressions of the contour extending in the axial direction, i.e. in the direction of or against the direction of the main flow. The undulation lengths of these contouring arrangements are determined in a manner analogous to the first embodiment of the invention. This means that the contour in the inlet region has an undulation length which is matched to the number of blade or vanes in the blade or vane row located adjacently upstream and a contour in the outlet region of the cavity has an undulation length which is matched to the number of blades or vanes in the blade or vane row located adjacently downstream.

In a third embodiment, the shrouds are contoured with the elevations and depressions extending inward and outward in the radial direction. In this case, both stationary and rotating parts are provided with a contour in accordance with the invention. In addition, this contouring of the shroud also effects an equalization of those pressure fields which are generated by the blading row which is associated with the shroud. The undulation length of such contouring is correspondingly matched to the number of blades or vanes in this blading row.

In a fourth embodiment of the invention, the shroud side walls or end walls are contoured with the elevations and depressions extending in the axial direction, i.e. in the direction of the main flow or in the opposite direction. Both stationary and rotating parts are again provided with a contour in accordance with the invention. The undulation lengths of the contouring arrangements are again matched to the pressure fields which they equalize and are matched to the number of blades or vanes of that row which is associated with the shroud.

Variants of the invention have arbitrary combinations of the four embodiments mentioned, by which means the effect of the pressure equalization is further increased.

A contouring arrangement has an arbitrary, periodically repeating shape which generates a pressure gradient. One preferred shape is a wave shape such, for example, as a sine wave shape. Further possible shapes are step shapes such as block shapes, triangular shapes, saw-tooth shapes or shapes similar to saw teeth.

The amplitude of the contouring, i.e. the maximum dimension of the elevations and depressions, starting from a central line between the extreme points of the contour, is selected in such a way that the curvature of the contour is sufficiently emphasized to generate appropriately strong pressure gradients which can equalize the pressure fields.

BRIEF DESCRIPTION OF THE DRAWINGS

FIG. 2*a* shows a longitudinal section of a turbomachine, along its shaft, in particular a cavity for the shroud of a rotor blade in accordance with the first embodiment of the invention with contouring in the peripheral direction of the cavity walls and of the shroud with elevations in radial direction, FIG. 2*b* shows an axial cross-sectional view of the cavity of FIG. 2*a*, which view shows a corrugated contour with elevations and depressions in the radial direction and also shows the positioning of the elevations relative to the blade position.

EMBODIMENT OF THE INVENTION

Figure 1:
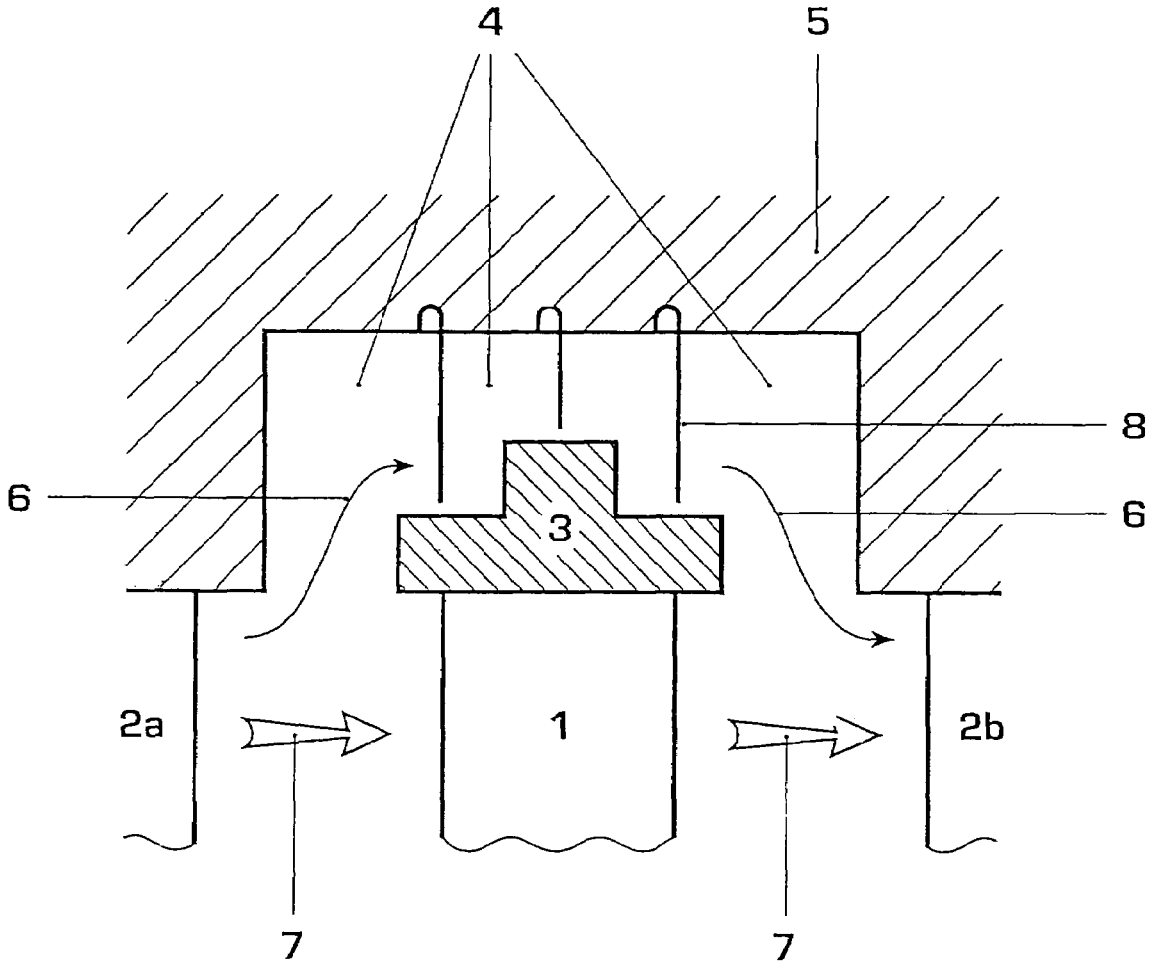
Fig. 1 Prior art
FIG. 1 shows a longitudinal section through a turbomachine and along its shaft, in accordance with the state of the art, in particular a cavity for the shroud of a rotor blade.

FIG. 2*a* shows the same excerpt from a turbomachine as is shown in FIG. 1. According to the invention, the cavity 4 has contouring arrangements 10 and 11 on the cavity walls in this case in accordance with the first embodiment of the invention. In this embodiment example, they are located in the inlet region 12 and the outlet region 13 of the cavity 4. The view shows a section through the contouring level with its elevations. In the embodiment shown here, the contouring in the inlet region is equal to the contouring in the outlet region of the cavity. In further embodiments, the contouring arrangements in the inlet region can differ from those in the outlet region. This can, for example, be the case for inclined duct walls.

The contouring arrangements 10 and 11 consist of solid parts, which extend from the original inner casing wall radially inward to the shroud 3. They can be effected by corresponding shaping of the inner casing as an integral part of the inner casing wall or by subsequent processing of the cavity by the fitting of insert rings. The use of insert rings also permits an existing machine to be retrofitted.

According to the third embodiment of the invention, the shroud 3 has a contour with elevations 14 and 15, which extend in the radial direction toward the contouring arrangements 10, 11. The contouring arrangement 10 in the inlet region 12 equalizes, in the peripheral direction, the pressure fields of the blading row with guide vanes 2*a*. The contouring arrangement 11 in the outlet region 13 correspondingly equalizes the pressure fields of the blading row with guide vanes 2*b*. The contouring arrangements 14 and 15 in the inlet and outlet regions equalize, in the peripheral direction, the pressure fields of the blading row with blades 1.

FIG. 2*b* shows a view of the machine along its shaft axis in the direction of the main flow. The blades 2*a* and the contouring arrangements 10 are shown in the peripheral direction in the inlet region of the cavity. They have a wave shape with an undulation length $L_1$, which is equal to the total peripheral length divided by the number of blades 2*a* of the blading row located upstream or the distance between two adjacent guide vanes 2*a*. The undulation length $L_1$ can, for example, also be equal to the peripheral length divided by a whole number multiple of the number of vanes mentioned, i.e. it may be only half or a quarter as large. The contouring arrangement 11 in the outlet region of the cavity has an undulation length corresponding to the number of blades 2*b* of the blading row located downstream. The undulation lengths of the contouring arrangements 10 and 11 may therefore be different in a given case. The undulation lengths of the shroud contour 14 in the inlet region 12 and the shroud contour 15 in the outlet region 13 are determined (in a manner analogous to the undulation lengths of the contours 10 and 11) to correspond with the number of rotor blades 1.

In the inlet region 12, the maxima of the elevations of the contouring arrangement 10 are positioned, relative to the guide vanes 2*a* located upstream, in order to optimize the pressure equalization as far as possible. In the outlet region 13, the maxima of the elevations of the contouring arrangement 11 are correspondingly positioned relative to the guide vanes 2*b* located downstream. (The positioning of the maxima and their amplitude are presented more precisely below in the example according to FIG. 3*b*.)

Figure 3A:
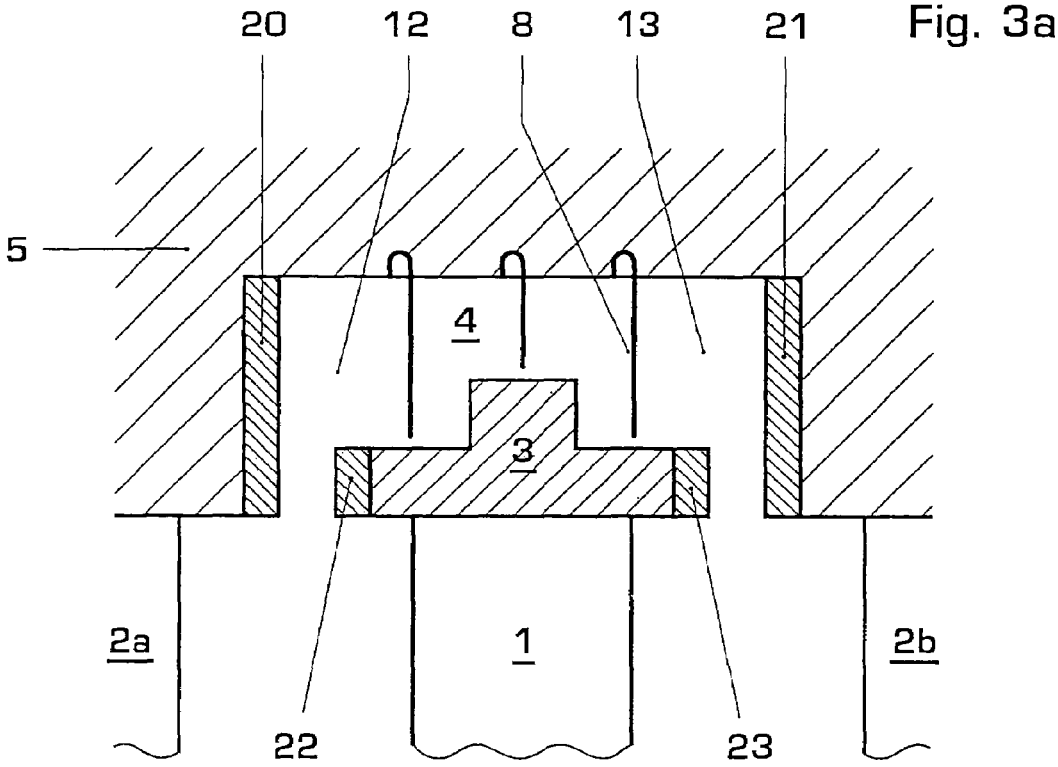
FIG. 3*a* shows a longitudinal section of a turbomachine, along its shaft, in particular a cavity for the shroud of a rotor blade in accordance with the second embodiment of the invention, with contouring of the cavity walls and the shroud in the peripheral direction with elevations in the axial direction.
Figure 3B:
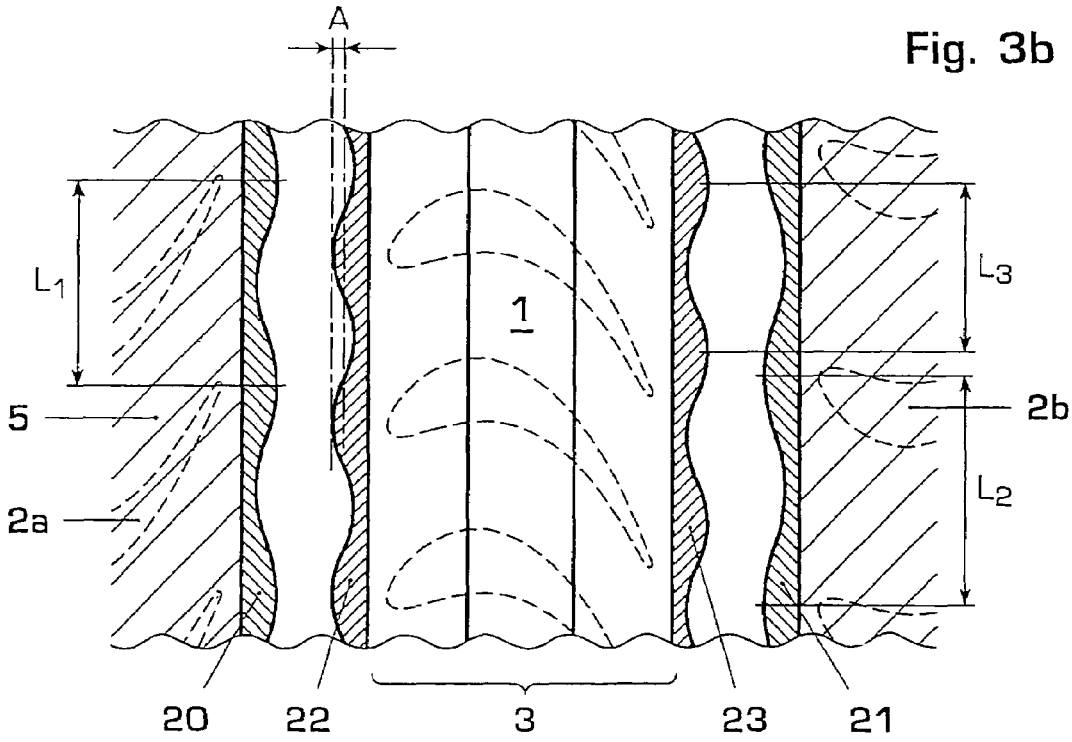
FIG. 3*b* shows a view of the shroud cavity of FIG. 3*a* from above and projected onto a plane with elevations and depressions in the axial direction.

FIGS. 3*a* and 3*b* show a combination of the second and fourth embodiments of the invention. FIG. 3*a* shows an excerpt from a turbomachine in accordance with FIGS. 1 and 2*a*, the same designations being employed for the same machine parts. According to the second embodiment of the invention, contouring is located on the radially extending wall of the cavity 4 in the form of elevations and depressions 20 in the inlet region 12 and of elevations and depressions 21 in the outlet region 13. The contouring arrangements 20 and 21 in this example are effected as an insert ring with wave-shaped contour, which ring is fastened to the inner casing wall. As an alternative, they could also be an integral constituent of the cavity.

In accordance with the fourth embodiment of the invention, the end surfaces of the shroud 3 are also provided with a contouring arrangement 22 in the inlet region 12 and a contouring arrangement 23 in the outlet region 13. Here again, these can be effected by integral shaping of the shroud or by the fitting of a correspondingly shaped ring fastened to the shroud. FIG. 3*b* shows the wave shape of the contouring arrangements 20-23 of FIG. 3*a* in the peripheral direction by projection of the cavity 4 onto a plane. The undulation length $L_1$ of the contour 20 on the radially extending cavity wall in the inlet region is, in this case, equal to the distance between two adjacent blades 2*a* of the blading row located upstream or equal to the total periphery of the cavity divided by the number of blades. The undulation length $L_2$ of the contour 21 in the outlet region of the cavity is equal to the distance between two adjacent blades 2*b* of the blading row located downstream. The undulation length $L_3$ of the contours 22 and 23 on the shroud end surfaces is also correspondingly equal to the distance between two adjacent blades 1 which are associated with the shroud. The maximum elevation of the undulations of all the contours are then located level with the blades to which the contour is matched.

In each case, the contouring arrangements have an amplitude A, which is equal to the dimension of an elevation or depression, starting from a central line between elevation and depression. The amplitude has a predetermined relationship with the original cavity height of the inlet region 12. The amplitudes A of the elevations and depressions on the shrouds also have a predetermined relationship to the original axial distance between shroud and cavity wall.

Figure 4:
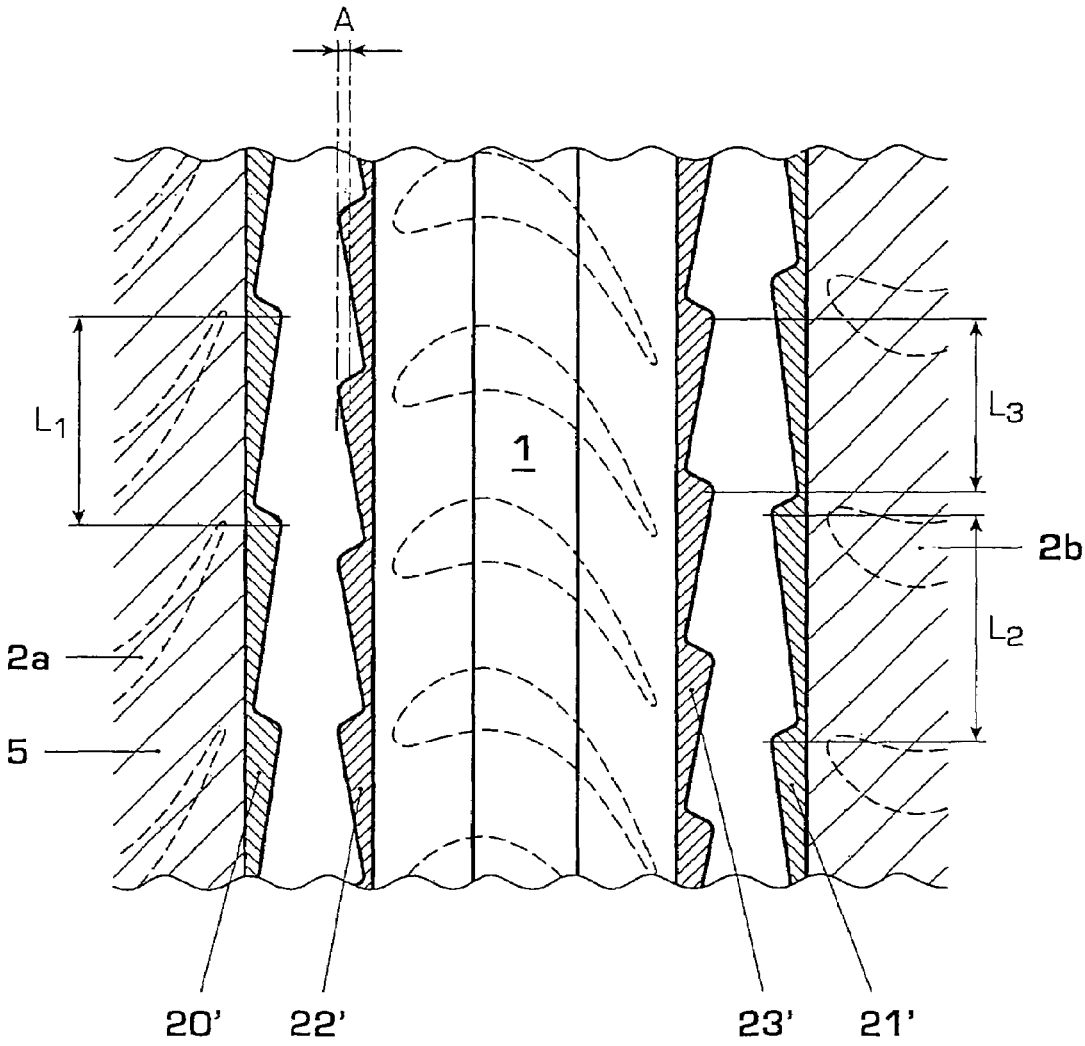
FIG. 4 shows a view of a shroud cavity from above and projected onto a plane with elevations and depressions in the axial direction and having a rounded saw-tooth profile.

FIG. 4 shows a further possible shape of the contour employed on the cavity contouring of FIG. 3*a*. Instead of a wave shape, the contour has a rounded saw-tooth shape 20', 21', 22', 23' in this case, the position of the maxima of the saw-tooth shape 20' being matched to the position of the vanes 2*a* of the blading row adjacent upstream, that of the contour 21' being matched to the position of the vanes 2*b* of the blading row adjacent downstream and that of the contours 22', 23' being matched to the position of the blades 1.

LIST OF DESIGNATIONS

1 Rotor blade
2*a* Guide vane
2*b* Guide vane
3 Shroud
4 Cavity
5 Inner casing
6 Leakage flow direction
7 Working flow direction
8 Sealing strips
10 Cavity contouring in peripheral direction
11 Cavity contouring in peripheral direction
12 Inlet region
13 Outlet region
14 Shroud contouring
15 Shroud contouring
20-23 Components for contouring
20'-23' Components for contouring
$L_1$, $L_2$, $L_3$ Undulation length
A Amplitude

The invention claimed is:

1. A turbomachine with guide vanes arranged in rows and fastened to an inner casing and rotor blades arranged in rows and fastened to a shaft, at least part of the blading rows being provided with shrouds and recesses being arranged on the inner casing and the shaft, into which recesses the shrouds protrude, wherein at least one recess and at least one shroud has contouring which varies in the peripheral direction of the recess.

2. The turbomachine as claimed in claim 1, wherein the contouring has periodic elevations and depressions which are uniformly distributed over the periphery of the recess.

3. The turbomachine as claimed in claim 1, wherein the varying contouring in the recess has, between sequential elevations, an undulation length which is equal to the peripheral length of the recess divided by the number of guide vanes in the blading row or divided by a whole number multiple of the number of guide vanes in the blading row which is immediately adjacent to the contouring.

4. The turbomachine as claimed in claim 1, wherein the varying contouring on the shrouds has an undulation length between sequential elevations which is equal to the peripheral length of the shroud divided by the number of blades in the blading row or divided by a whole number multiple of the number of blades in the blading row which is associated with the shroud.

5. The turbomachine as claimed in claim 1, wherein the varying contouring has a periodically repeating wave shape, step shape, block shape, triangular shape or saw-tooth shape.

6. The turbomachine as claimed in claim 1, wherein the recess has an inlet region, into which a leakage flows, and an outlet region, through which the leakage flows out of the recess, and the contouring extends over the periphery of the axially extending side walls of the inlet region of the recess and/or over the periphery of the axially extending side walls of the outlet region of the recess, and the elevations and depressions extend in the radial direction.

7. The turbomachine as claimed in claim 1, wherein the recess has an inlet region, into which a leakage flows, and an outlet region, through which the leakage flows out of the recess, and the contouring extends over the periphery of the radially extending side wall of the inlet region of the recess and/or over the periphery of the radially extending side wall of the outlet region, and the elevations and depressions extend in the axial direction.

8. The turbomachine as claimed in claim 1, wherein the contouring extends over the periphery of the end surfaces of the shrouds, and the elevations and depressions extend in the axial direction.

9. The turbomachine as claimed in claim 1, wherein the contouring extends over the periphery of the shrouds in the inlet region and/or in the outlet region of the recess, and the elevations and depressions extend in the radial direction.

10. The turbomachine as claimed in claim 1, wherein the contouring is formed by insert rings, which are fastened to the walls of the recess or to the shrouds.

11. The turbomachine as claimed in claim 1, wherein the contouring is formed by integral shaping of the side walls of the recess or of the shrouds.

12. The turbomachine as claimed in claim 1, wherein the shrouds are attached to tips of the blades.

* * * * *